US012729863B2

(12) United States Patent
Yamamoto

(10) Patent No.: US 12,729,863 B2
(45) Date of Patent: Sep. 8, 2026

(54) VENTILATION DEVICE AND VENTILATION SYSTEM

(71) Applicant: Panasonic Intellectual Property Management Co., Ltd., Osaka (JP)

(72) Inventor: Naotake Yamamoto, Osaka (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 502 days.

(21) Appl. No.: 18/275,671

(22) PCT Filed: Feb. 15, 2021

(86) PCT No.: PCT/JP2021/005560
§ 371 (c)(1),
(2) Date: Aug. 3, 2023

(87) PCT Pub. No.: WO2022/172461
PCT Pub. Date: Aug. 18, 2022

(65) Prior Publication Data
US 2024/0110707 A1 Apr. 4, 2024

(51) Int. Cl.
*F24C 15/20* (2006.01)

(52) U.S. Cl.
CPC ..... *F24C 15/2021* (2013.01); *F24C 15/2071* (2013.01)

(58) Field of Classification Search
None
See application file for complete search history.

(56) References Cited

U.S. PATENT DOCUMENTS

2014/0009355 A1 1/2014 Samardzija et al.
2016/0088131 A1 3/2016 Chiu
(Continued)

FOREIGN PATENT DOCUMENTS

CN 110207234 A 9/2019
JP 2014-228217 A 12/2014
(Continued)

OTHER PUBLICATIONS

Office Action issued in Japan Counterpart Patent Appl. No. 2019-206579, dated Jul. 4, 2023.
(Continued)

*Primary Examiner* — Ko-Wei Lin
(74) *Attorney, Agent, or Firm* — GREENBLUM & BERNSTEIN, P.L.C.

(57) ABSTRACT

A ventilation device includes a main body case made of metal, a fan, a wireless communications unit, and a controller. Controller is configured to control fan in accordance with a signal received by the wireless communications unit. Main body case includes a suction section and an exhaust section. Suction section has a box shape, and includes a suction port. Suction section has a lower surface, an upper surface, and a front surface connecting a front edge of lower surface and a front edge of upper surface. Exhaust section is positioned on upper surface of suction section and includes exhaust port. Suction section includes a first opening and a second opening. First opening is in upper surface, and overlapped with at least part of wireless communications unit in upward-downward directions. Second opening is in front surface, and overlapped with at least part of wireless communications unit in forward-backward directions.

11 Claims, 9 Drawing Sheets

(56) References Cited

U.S. PATENT DOCUMENTS

| | | | | |
|---|---|---|---|---|
| 2016/0123603 | A1* | 5/2016 | Chen | F21V 33/0092 126/299 D |
| 2018/0087781 | A1* | 3/2018 | Hasegawa | F24F 11/30 |
| 2018/0135864 | A1* | 5/2018 | Hanazono | G10K 11/17853 |

FOREIGN PATENT DOCUMENTS

| | | | |
|---|---|---|---|
| JP | 2015-207398 | A | 11/2015 |
| JP | 2018-54282 | A | 4/2018 |
| JP | 2018-92457 | A | 6/2018 |
| JP | 2018-105517 | A | 7/2018 |
| JP | 2021-81091 | A | 5/2021 |
| WO | 2021/024292 | A1 | 2/2021 |

OTHER PUBLICATIONS

International Search Report issued in International Patent Application No. PCT/JP2021/005560, dated Apr. 27, 2021, along with an English translation thereof.

* cited by examiner

VENTILATION DEVICE AND VENTILATION SYSTEM

CROSS-REFERENCE TO RELATED APPLICATIONS

This application is a National Stage of International Application No. PCT/JP2021/005560 filed Feb. 15, 2021. The content of the above-identified application is incorporated herein by reference in its entirety.

TECHNICAL FIELD

The present disclosure generally relates to ventilation devices and ventilation systems. More particularly, the present disclosure relates to a ventilation device to be used for indoor ventilation, and a ventilation system including the ventilation device.

BACKGROUND ART

Patent Literature 1 discloses a range hood (ventilation device) to be installed above a heating cooker. The range hood disclosed in Patent Literature 1 includes a fan unit, a frame unit, a straightening plate, and a communications module.

The frame unit is connected to the fan unit. The straightening plate is provided below the frame unit.

The frame unit includes a mounting part, which is made of metal and mounts thereon the communications module. The mounting part has a box shape and includes, for example, an opening in an upper surface thereof.

The communications module includes a transmitting/receiving unit case and a transmitting/receiving unit. The transmitting/receiving unit case includes a case part and a cover part. The case part covers the transmitting/receiving unit. The cover part is made of, for example, resin or glass. The communications module is inserted into the mounting part from the opening of the mounting part. In the communications module, the cover part of the transmitting/receiving unit case is fixed to the upper surface of the mounting part so as to close the opening of the mounting part.

In the technical field of the ventilation device, the communication performance is desired to be further improved.

CITATION LIST

Patent Literature

Patent Literature 1: JP 2018-54282 A

SUMMARY OF INVENTION

It is therefore an object of the present disclosure to provide a ventilation device and a ventilation system, all of which can contribute to improving communication performance.

A ventilation device according to an aspect of the present disclosure includes a main body case, a fan, a wireless communications unit, and a controller. The main body case is made of metal. The main body case includes a suction port and an exhaust port. The fan is disposed in the main body case. The wireless communications unit includes an antenna, and is configured to perform wireless communication by using a radio wave having a prescribed wavelength as a medium. The controller is connected to the wireless communications unit. The controller is configured to control the fan in accordance with a signal received by the wireless communications unit. The main body case includes a suction section and an exhaust section. The suction section has a box shape, and includes the suction port. The suction section has a lower surface, an upper surface, and a front surface connecting a front edge of the lower surface and a front edge of the upper surface. The exhaust section is positioned on the upper surface of the suction section and includes the exhaust port. The suction section includes a first opening and a second opening. The first opening is in the upper surface, and overlapped with at least part of the wireless communications unit in upward-downward directions. The second opening is in the front surface, and overlapped with at least part of the wireless communications unit in forward-backward directions.

A ventilation system according to an aspect of the present disclosure includes the ventilation device and an apparatus. The apparatus is configured to perform wireless communication with the wireless communications unit of the ventilation device.

DESCRIPTION OF EMBODIMENTS

FIGS. 1A, 1B, 2, 3, 7A, 7B, 9A and 9B to be referred to in the following embodiment or the like are all schematic representations. Thus, the ratio of the dimensions (including thicknesses) of respective constituent elements illustrated on the drawings does not always reflect their actual dimensional ratio.

EMBODIMENT

Hereinafter, a ventilation device 1 according to an embodiment and a ventilation system 100 including the ventilation device 1 will be described with reference to FIGS. 1A to 5.

(1) Overview

Figure 2:
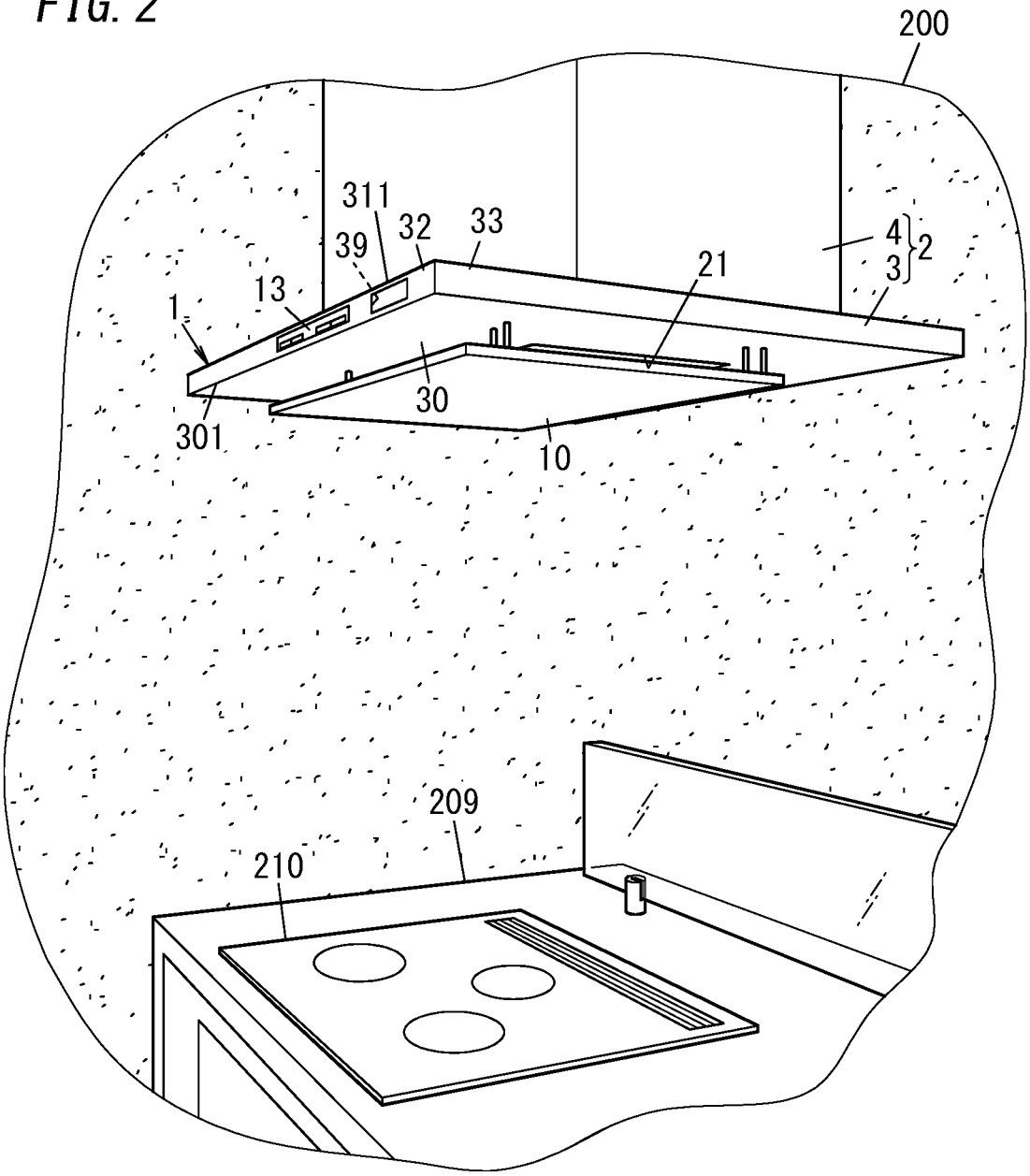
FIG. 2 is a perspective view for explaining an installation example of the ventilation device.

For example, as shown in FIG. 2, the ventilation device 1 according to the embodiment is implemented as a range hood to be installed above a cooking device 210. In the example of FIG. 2, the ventilation device 1 is illustrated to be installed above the cooking device 210 in a kitchen 209 of a residence 200. The residence 200 is assumed to be, for example, a two-story dwelling house but should not be construed as limiting. Alternatively, the residence 200 may be a one-story dwelling house, a three-story dwelling house, or a dwelling unit of multi-family dwelling houses. The cooking device 210 is assumed to be, for example, an electromagnetic cooker but should not be construed as limiting. Alternatively, the cooking device 210 may be, for example, a gas stove. In the case that the residence 200 is a two-story dwelling house or a three-story dwelling house, the cooking device 210 may be located, for example, in a kitchen on the first floor of the residence 200.

The installation location of the ventilation device 1 is not limited to buildings (single-family dwelling houses, multi-family dwelling houses, commercial facilities, shops, factories, amusement facilities, theme parks, airports, railway stations, dome stadiums, hotels, and the like). The installation location of the ventilation device 1 may be movers such as trains or vessels. The ventilation device 1 is configured to ventilate an indoor space by exhausting the indoor air outdoor.

Figure 1A:
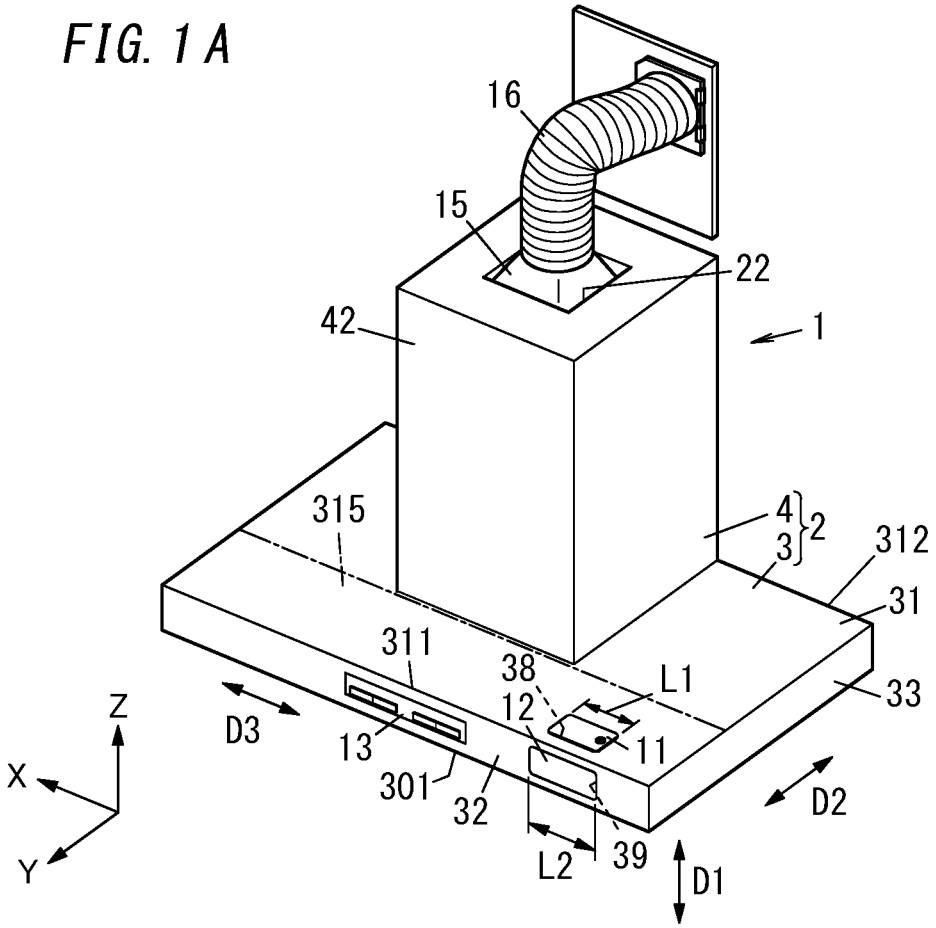
FIG. 1A is a perspective view of a ventilation device according to an exemplary embodiment, when viewed from above.
Figure 3:
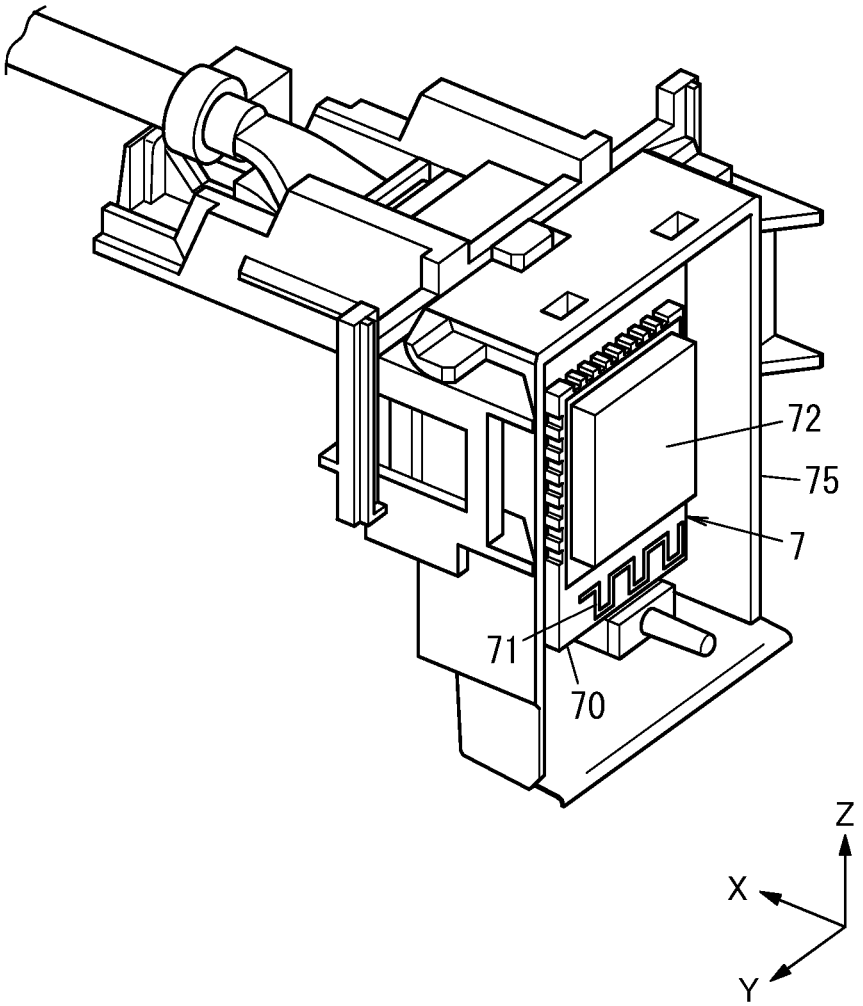
FIG. 3 is a perspective view of the wireless communications unit of the ventilation device.
Figure 4:
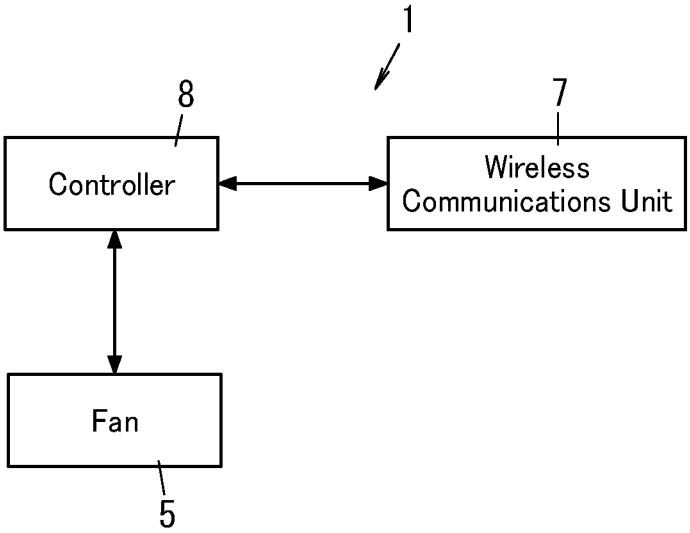
FIG. 4 is a block diagram of the ventilation device.

As shown in FIGS. 1A and 4, the ventilation device 1 includes a main body case 2, a fan 5, a wireless communications unit 7, and a controller 8. The main body case 2 is made of metal. The main body case 2 includes a suction port 21 (refer to FIG. 2) and an exhaust port 22. The fan 5 (refer to FIG. 4) is disposed in the main body case 2. The wireless communications unit 7 includes an antenna 71 (refer to FIGS. 1B and 3), and is configured to perform wireless communication by using a radio wave having a prescribed wavelength as a medium. The controller 8 (refer to FIG. 4) is connected to the wireless communications unit 7. The controller 8 is configured to control the fan 5 in accordance with a signal received by the wireless communications unit 7.

Figure 5:
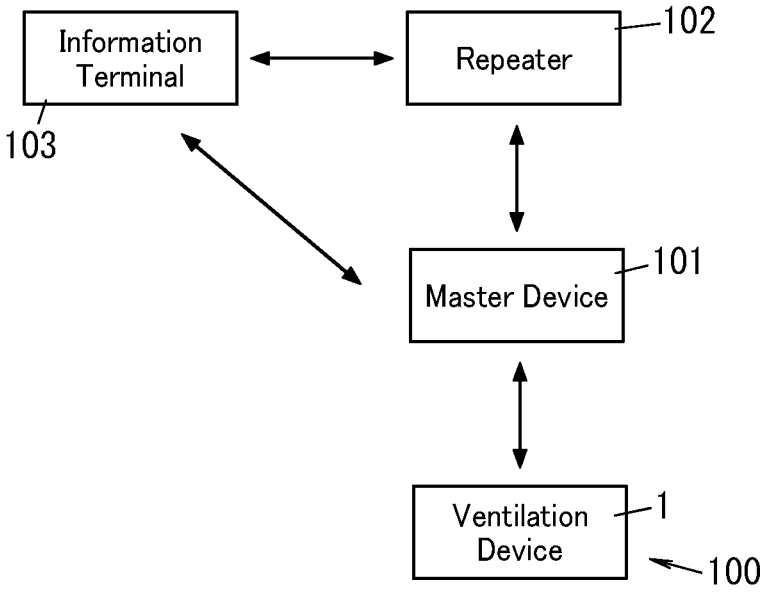
FIG. 5 is an explanatory diagram of a ventilation system including the ventilation device.

As shown in FIG. 5, the ventilation system 100 includes the ventilation device 1 and a master device 101 as an apparatus. The master device 101 is configured to perform wireless communication with the wireless communications unit 7 of the ventilation device 1. The ventilation system 100 may further include a repeater 102. In the case that the ventilation system 100 further includes the repeater 102, the ventilation device 1 is also configured to perform wireless communication with the repeater 102. The ventilation system 100 may further include an information terminal 103. In the case that the ventilation system 100 further includes the information terminal 103, the information terminal 103 is configured to perform wireless communication with the master device 101. The information terminal 103 is, for example, a mobile terminal to be carried by a user of the ventilation device 1 or any other person and is a communication terminal such as a smartphone. The information terminal 103 is not limited to a smartphone, and may be, for example, a tablet-type mobile terminal or a desktop-type computer.

(2) Detail

As shown in FIGS. 1A to 4, the ventilation device 1 includes the main body case 2, the fan 5, the wireless communications unit 7, and the controller 8. The ventilation device 1 further includes a straightening plate 10 (refer to FIG. 2). The ventilation device 1 further includes a duct connector 15. The ventilation device 1 further includes a first cover 11 and a second cover 12.

The main body case 2 includes a suction section 3 and an exhaust section 4. In the main body case 2, the suction section 3 made of metal (e.g., stainless steel) and the exhaust section 4 made of metal (e.g., stainless steel), which are formed separately from each other, are integrally coupled to each other but should not be construed as limiting. Alternatively, the suction section 3 and the exhaust section 4 may be formed integrally as a single section without being formed separately from each other and coupled to each other.

The suction section 3 has a box shape, and includes the suction port 21 (refer to FIG. 2). The suction section 3 has a lower surface 30 (refer to FIG. 2), an upper surface 31, and a front surface 32 connecting a front edge 301 of the lower surface 30 and a front edge 311 of the upper surface 31. The suction section 3 has a dimension in upward-downward directions D1 smaller than each of: a dimension thereof in forward-backward directions D2; and a dimension thereof in directions D3 perpendicular to all the upward-downward directions D1 and the forward-backward directions D2. The suction section 3 has a flat rectangular (or square) box shape.

The suction section 3 includes the suction port 21 in the lower surface 30. The suction port 21 has, for example, an opening shape like a rectangle (or square). The ventilation device 1 further includes, in the suction section 3, a filter and an oil catcher, which are disposed above the suction port 21. The filter is, for example, a baffle filter and disposed in the main body case 2. The oil catcher is provided to catch the oil from the filter disposed in the main body case 2.

In the ventilation device 1, the straightening plate 10 is disposed below the main body case 2. The straightening plate 10 is made of metal (e.g., stainless steel). The straightening plate 10 has a rectangular (or square) plate shape, and is disposed apart from the lower surface 30 and the suction port 21 of the suction section 3 in the upward-downward directions D1. The straightening plate 10 is supported by the main body case 2. When the ventilation device 1 is viewed from below, the straightening plate 10 is smaller than the suction section 3. In this embodiment, when the ventilation device 1 is viewed from below, the straightening plate 10 is positioned inside of an outer edge of the suction section 3 and further overlapped with the whole area of the suction port 21. In the ventilation device 1, indoor air enters the suction port 21 through a gap between the main body case 2 and the straightening plate 10. Since the ventilation device 1 includes the straightening plate 10, the ventilation device 1 can increase the speed at which the air is sucked and therefore suppress the oil and the like included in the air from being escaped.

The exhaust section 4 is positioned on the upper surface 31 of the suction section 3 and includes the exhaust port 22. The exhaust section 4 has a tubular shape (a rectangular tubular shape in the example of the figure). The exhaust section 4 has an inner space connected to an inner space of the suction section 3. Accordingly, a flow channel to allow the air to flow is provided between the suction port 21 and the exhaust port 22 in the main body case 2.

The exhaust section 4 is disposed apart from the front edge 311 of the upper surface 31 in the forward-backward directions D2 on the upper surface 31 of the suction section 3. Thus, in the ventilation device 1, the upper surface 31 of the suction section 3 includes a front-side region 315 on which the exhaust section 4 is not provided. The front-side region 315 has a rectangular shape (or a square shape), and is between the front edge 311 of the upper surface 31 and a plane including a front surface 42 of the exhaust section 4. In the ventilation device 1 according to the embodiment, a distance between the exhaust section 4 and the front edge 311 of the upper surface 31 of the suction section 3 is longer than a distance between the exhaust section 4 and a rear edge 312 of the upper surface 31 of the suction section 3 in the forward-backward directions D2, but should not be construed as limiting.

The fan 5 (refer to FIG. 4) is disposed in the inner space of the exhaust section 4 of the main body case 2. The fan 5 is configured to suck air through the suction port 21 of the main body case 2 and blow out, from the exhaust port 22, the air thus sucked. The fan 5 is implemented as an electric fan including a motor.

The duct connector 15 is connected to an upper end of the exhaust section 4. The duct connector 15 has a tubular shape. The duct connector 15 has an inner space connected to the inner space of the exhaust section 4. To the duct connector 15, a duct 16 is connected.

In the ventilation device 1, when the operation of the fan 5 is started, the air is sucked from the suction port 21 of the suction section 3 and then exhausted outdoor through the exhaust section 4, the duct connector 15, the duct 16 and any other element.

The controller 8 is configured to start operating of the fan 5, stop operating of the fan 5, or change the air volume of the fan 5 in accordance with contents included in a signal received from the master device 101 (refer to FIG. 5) by the wireless communications unit 7. The ventilation device 1 is configured to change the air volume to be switched between two or more stages (in this embodiment, two stages) and operate in either a normal operation mode with a relatively low air volume or a high operation mode with a relatively high air volume. That is to say, the operation mode of the ventilation device 1 includes the normal operation mode and the high operation mode.

The controller 8 is electrically connected to the wireless communications unit 7. The controller 8 is electrically connected to the motor of the fan 5. The controller 8 is configured to control the fan 5 in accordance with the signal received from the master device 101 by the wireless communications unit 7. The ventilation device 1 further includes a power supply circuit that is connected to an external power supply to supply a voltage to the controller 8.

The controller 8 allows the motor of the fan 5 to operate, for example, when finding that the signal received from the master device 101 by the wireless communications unit 7 is a signal indicating starting of the operation of the ventilation device 1. In case that the ventilation device 1 is configured to operate in any one selected from a plurality of operation modes (e.g., a high operation mode, an intermediate operation mode, or a low operation mode) as the operation mode, when finding that the signal received from the master device 101 by the wireless communications unit 7 is a signal indicating a request for transmission of information about the operation state of the ventilation device 1, the controller 8 transmits the information about the operation state of the fan 5 to the master device 101 by wireless communication. When finding that the signal received from the master device 101 by the wireless communications unit 7 is a signal indicating stopping of the operation of the ventilation device 1, the controller 8 allows the motor of the fan 5 to stop.

Also, the operation of the controller 8 is set, for example, in response to that the user operates the information terminal 103 (refer to FIG. 5). The wireless communications unit of the information terminal 103 is set through the repeater 102 (refer to FIG. 5), the master device 101 (refer to FIG. 5), and the wireless communications unit 7. In the ventilation system 100 shown in FIG. 5, the communication method of the wireless communications unit of the information terminal 103 is Wi-Fi (registered trademark), and the repeater 102 is implemented as a router compatible with Wi-Fi (registered trademark). The communication method between the information terminal 103 and the repeater 102 is not limited to Wi-Fi (registered trademark), but may be a communication method conforming to, for example, the standard of Bluetooth (registered trademark) Low Energy, or Ethernet (registered trademark). The repeater 102 is not limited to the router compatible with Wi-Fi (registered trademark) as long as the repeater 102 can perform the wireless communication with the information terminal 103. The communication method between the repeater 102 and the master device 101 may be a wireless communication method or a wired communication method.

The controller 8 may be configured as a microcomputer including a processor and a memory. That is to say, the controller 8 may be implemented as a computer system including the processor and the memory. The computer system functions as the controller 8 by the processor executing an appropriate program. The program may be stored in advance in the memory. Alternatively, the program may also be downloaded via a telecommunications network such as the Internet or distributed after having been stored in a non-transitory storage medium such as a memory card.

As shown in FIG. 1A, the ventilation device 1 further includes an input unit 13 provided to the front surface 32 of the suction section 3. The input unit 13 is operated by the user, for example, when the user manually commands starting the operation of the fan 5, stopping the operation of the fan 5, or changing the air volume of the fan 5. The controller 8 is electrically connected to the input unit 13 and configured to start the operation of the fan 5, stop the operation of the fan 5, or change the air volume of the fan 5 in response to an output of the input unit 13. The input unit 13 also includes a display unit to display the operation state of the ventilation device 1 (e.g., the operation state of the fan 5).

In the ventilation device 1, the suction section 3 further includes a first opening 38 and a second opening 39. The first opening 38 is in the upper surface 31 of the suction section 3. The first opening 38 is overlapped with at least part of the wireless communications unit 7 in the upward-downward directions D1. In this embodiment, the first opening 38 is between the front edge 311 of the upper surface 31 and the exhaust section 4 in the upper surface 31 of the suction section 3. The second opening 39 is in the front surface 32 of the suction section 3. The second opening 39 is overlapped with at least part of the wireless communications unit 7 in the forward-backward directions D2. The wireless communications unit 7 is overlapped with the front-side region 315 of the upper surface 31 of the suction section 3 in the upward-downward directions D1. The first opening 38 is in the front-side region 315. In this embodiment, the wireless communications unit 7, the first opening 38 and the second opening 39 are in the vicinity of the front edge 311 of the upper surface 31 of the suction section 3. The wireless communications unit 7 is disposed below the first opening 38 in the upward-downward directions D1, and behind the second opening 39 in the forward-backward directions D2. In manufacturing of the ventilation device 1, the wireless communications unit 7 is inserted into the suction section 3 from the first opening 38 to be disposed in the suction section 3.

Figure 1B:
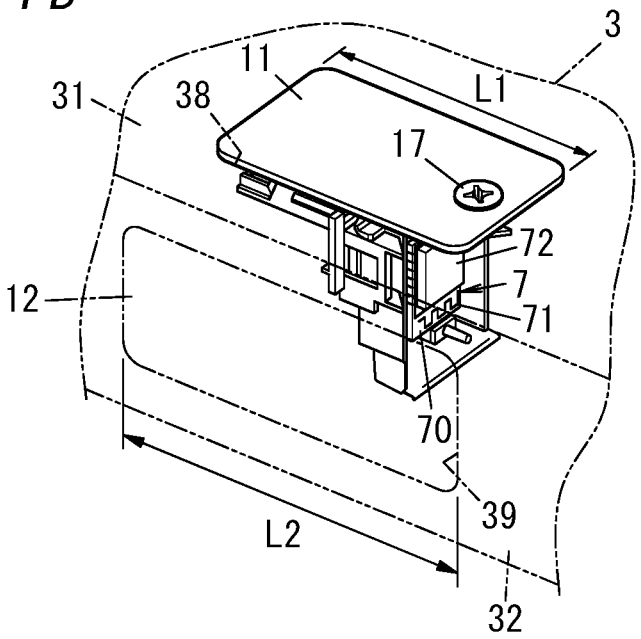
FIG. 1B is a see-through and perspective view of a wireless communications unit of the ventilation device.

As shown in FIGS. 1B and 3, the wireless communications unit 7 includes a printed board 70, an antenna 71, a Radio Frequency Integrated Circuit (RFIC) 72, and a matching circuit.

The matching circuit is provided between the antenna 71 and the RFIC 72. The outer circumferential shape of the printed board 70 is rectangular, when viewed in a thickness direction of the printed board 70. The printed board 70 has a first principal surface (surface) and a second principal surface (back surface), each of which intersects with the thickness direction of the printed board 70. The antenna 71 is implemented as, for example, a meander-shaped radiation conductor (a patterned conductor) provided at one end of the printed board 70 in a longitudinal direction thereof on the first principal surface of the printed board 70. The antenna 71 is disposed to be separated from an outer periphery of the printed board 70. The RFIC 72 is mounted on the first principal surface of the printed board 70. The matching circuit is a circuit for matching the impedance of the antenna 71 side with the impedance of the RFIC 72 side.

The wireless communications unit 7 further includes a first connector for external connection, disposed on the second principal surface of the printed board 70. The wireless communications unit 7 further includes a module case 75 (refer to FIG. 3). The module case 75 houses therein a wireless communication module including the printed board 70, the antenna 71, and the RFIC 72. The material of the module case 75 is resin. In FIGS. 1B and 3, a resist layer covering the antenna 71 on the printed board 70 is not shown. In the ventilation device 1 according to the embodiment, the wireless communications unit 7 is arranged such that the first principal surface of the printed board 70 faces a side surface 33, which is closer to the wireless communications unit 7, of two side surfaces of the suction section 3, adjacent to the front surface 32.

The wireless communications unit 7 is configured to perform wireless communication by using a radio wave having a prescribed wavelength as a medium. The communication method of the wireless communications unit 7 is, for example, Zigbee (registered trademark) of the wireless communication standard. The wireless communications unit 7 uses any one channel selected from 16 channels in a frequency band of, for example, 2.4 GHz as the prescribed wavelength. Accordingly, when the wireless communications unit 7 uses, for example, a channel with a center frequency of 2.405 GHz that is the lowest center frequency in the center frequencies of the 16 channels, the prescribed wavelength is about 125 mm. When the wireless communications unit 7 uses, for example, a channel with a center frequency of 2.48 GHz that is the highest center frequency in the center frequencies of the 16 channels, the prescribed wavelength is about 120 mm. The wireless communication standard of the wireless communications unit 7 is not limited to Zigbee (registered trademark), but may be, for example, Wi-Fi (registered trademark), Bluetooth (registered trademark), Bluetooth (registered trademark) Low Energy, or specific low-power radio.

As shown in FIG. 1B, the wireless communications unit 7 is disposed in the suction section 3 such that the antenna 71 is positioned below the RFIC 72 in the upward-downward directions D1. Also, the wireless communications unit 7 is disposed at the right of the input unit 13 (refer to FIG. 1A), when the suction section 3 is viewed from front. FIG. 1A shows the side surface 33, which is closer to the wireless communications unit 7, of the two side surfaces of the suction section 3, adjacent to the front surface 32.

The first opening 38 is overlapped with the antenna 71 in the upward-downward directions D1. The first opening 38 has an opening shape like a rectangle laterally long. That is to say, the opening shape of the first opening 38 is rectangular and the longitudinal direction thereof corresponds to the directions D3 (hereinafter, refer to as "rightward-leftward directions D3") perpendicular to all the upward-downward directions D1 and the forward-backward directions D2. As one example, the opening shape of the first opening 38 is a rectangle with long sides of 77.6 mm and short sides of 52.4 mm A maximum opening width L1 of the first opening 38 in the rightward-leftward directions D3 is, for example, larger than 60 mm as a half of the prescribed wavelength. As one example, the maximum opening width L1 is 77.6 mm.

The second opening 39 is overlapped with the antenna 71 in the forward-backward directions D2. The second opening 39 has an opening shape like a rectangle laterally long. That is to say, the opening shape of the second opening 39 is rectangular and the longitudinal direction thereof corresponds to the rightward-leftward directions D3. As one example, the opening shape of the second opening 39 is a rectangle with long sides of 100 mm and short sides of 40 mm A maximum opening width L2 of the second opening 39 in the rightward-leftward directions D3 is, for example, larger than 60 mm as a half of the prescribed wavelength. As one example, the maximum opening width L2 is 100 mm.

In the ventilation device 1, when the main body case 2 is viewed from above, the first opening 38 and the second opening 39 are overlapped with each other in the forward-backward directions D2. In this embodiment, a part of the second opening 39 in the rightward-leftward directions D3 is overlapped with the first opening 38 over the entire length of the first opening 38 in the rightward-leftward directions D3.

The ventilation device 1 further includes the first cover 11 and the second cover 12.

The first cover 11 is disposed to cover the first opening 38, and allows the radio wave having the prescribed wavelength to pass through the first cover 11. Accordingly, even when the first cover 11 is disposed, the wireless communications unit 7 can perform the communication with the master device 101. The material of the first cover 11 includes a resin (e.g., ABS resin). The first cover 11 is attached to the main body case 2, after the wireless communications unit 7 is inserted into the main body case 2 from the first opening 38. The first cover 11 is fixed to the main body case 2 by, for example, screwing a screw 17 (refer to FIG. 1B). The material of the first cover 11 is not limited to the resin, but may be a glass.

The second cover 12 is disposed to cover the second opening 39, and allows the radio wave having the prescribed wavelength to pass through the second cover 12. Accordingly, even when the second cover 12 is disposed, the wireless communications unit 7 can perform the communication with the master device 101. The material of the second cover 12 includes a resin (e.g., ABS resin). The material of the second cover 12 is not limited to the resin, but may be a glass. The second cover 12 is attached to the main body case 2 from the inside of the main body case 2 but should not be construed as limiting. Alternatively, the second cover 12 may be attached to the main body case 2 from the outside of the main body case 2.

(3) Communication Performance of Wireless Communications Unit in Ventilation Device Hereinafter, to explain the communication performance of the wireless communications unit 7 of the ventilation device 1 according to the embodiment, as an example, the right-hand system rectangular coordinates are defined with respect to the antenna 71 of the wireless communications unit 7, as shown in the lower left of FIG. 1A. The right-hand system rectangular coordinates have three axes of an X-axis, a Y-axis, and a Z-axis, which are orthogonal to one another. The origin of the rectangular coordinates is defined as an end of the antenna 71. In FIG. 1A, a direction opposite to a direction toward the side surface 33, of the rightward-leftward directions D3, is defined as a positive direction of the X-axis. Also in FIG. 1A, a forward direction of the forward-backward directions D2 is defined as a positive direction of the Y-axis. Also in FIG. 1A, an upward direction of the upward-downward directions D1 is defined as a positive direction of the Z-axis. The X-axis, Y-axis, and Z-axis are all virtual axes, and the arrows representing "X," "Y," and "Z" in FIG. 1A are illustrated merely for convenience of explanation and have no entity. The positive direction of the Z-axis (i.e., +Z direction) corresponds to the upward direction of the ventilation device 1 when the ventilation device 1 is installed. A negative direction of the Z-axis (i.e., −Z direction) corresponds to the downward direction of the ventilation device 1 when the ventilation device 1 is installed. The positive direction of the X-axis (i.e., +X direction), a negative direction of the X-axis (i.e., −X direction), the positive direction of the Y-axis (i.e., +Y direction) and a negative direction of the Y-axis (i.e., −Y direction) are not intended to be limited to specific directions when the ventilation device 1 is installed.

Hereinafter, first, a ventilation device 1*r* according to a comparative example will be described with reference to FIG. 7, and then the communication performance of the wireless communications unit 7 of the ventilation device 1 according to the embodiment will be described with reference to FIGS. 6A to 6C. Regarding the ventilation device 1*r* according to the comparative example, elements similar to those of the ventilation device 1 according to the embodiment are assigned with same reference signs, and the explanations thereof are appropriately omitted.

Figure 8A:
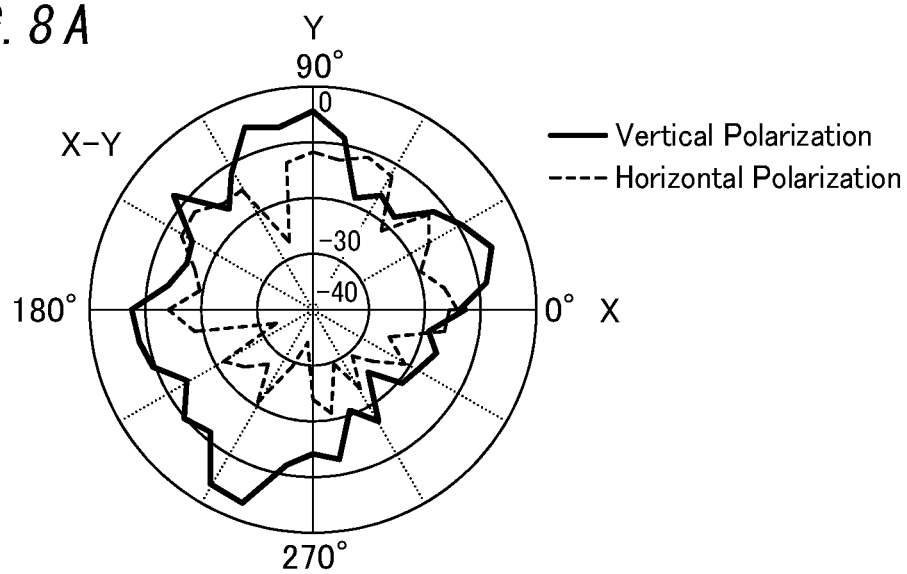
FIG. 8A is a characteristic diagram in X-Y directions, of the wireless communications unit of the ventilation device according to the comparative example.
Figure 8B:
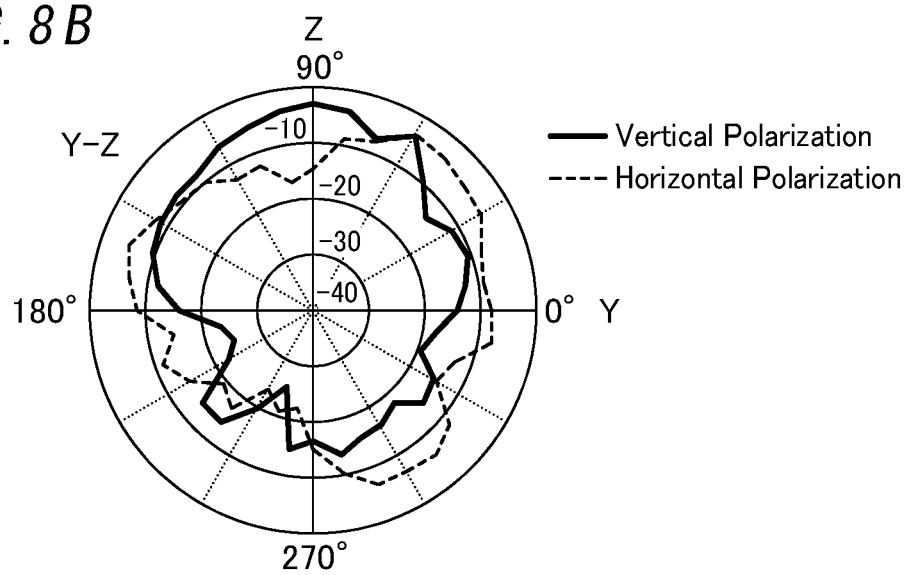
FIG. 8B is a characteristic diagram in Y-Z directions, of the wireless communications unit of the ventilation device according to the comparative example.
Figure 8C:
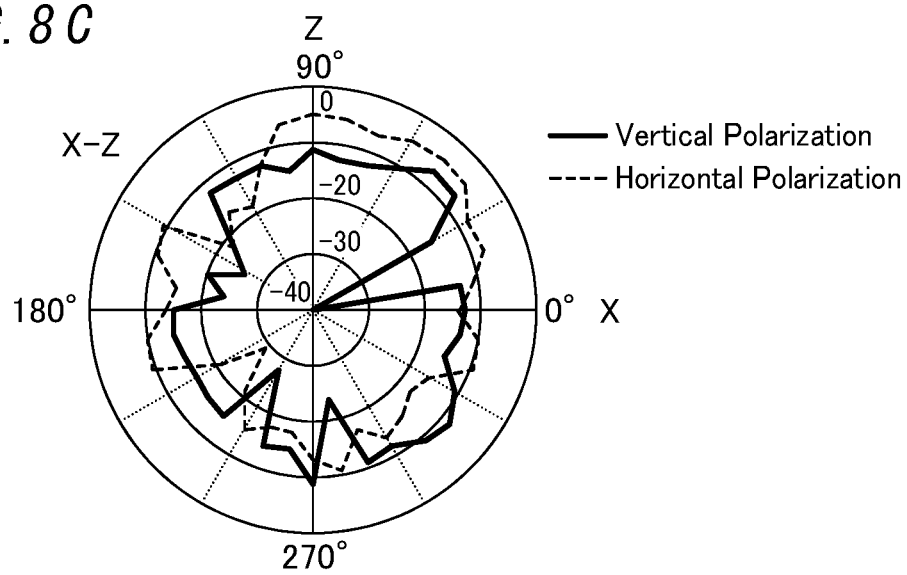
FIG. 8C is a characteristic diagram in X-Z directions, of the wireless communications unit of the ventilation device according to the comparative example.

The ventilation device 1*r* according to the comparative example is different from the ventilation device 1 according to the embodiment in that the ventilation device 1*r* does not include the second opening 39 and the second cover 12 of the ventilation device 1 according to the embodiment. The ventilation device 1*r* according to the comparative example includes a wireless communications unit 7 with a configuration almost the same as that of the ventilation device 1 according to the embodiment. To explain the communication performance of the wireless communications unit 7 of the ventilation device 1*r* according to the comparative example, the rectangular coordinates, which are the same as the rectangular coordinates in the lower left of FIG. 1A, are shown also in the lower left of FIG. 7A. FIGS. 8A to 8C show the communication performance of the wireless communications unit 7 of the ventilation device 1*r* according to the comparative example.

Figure 6A:
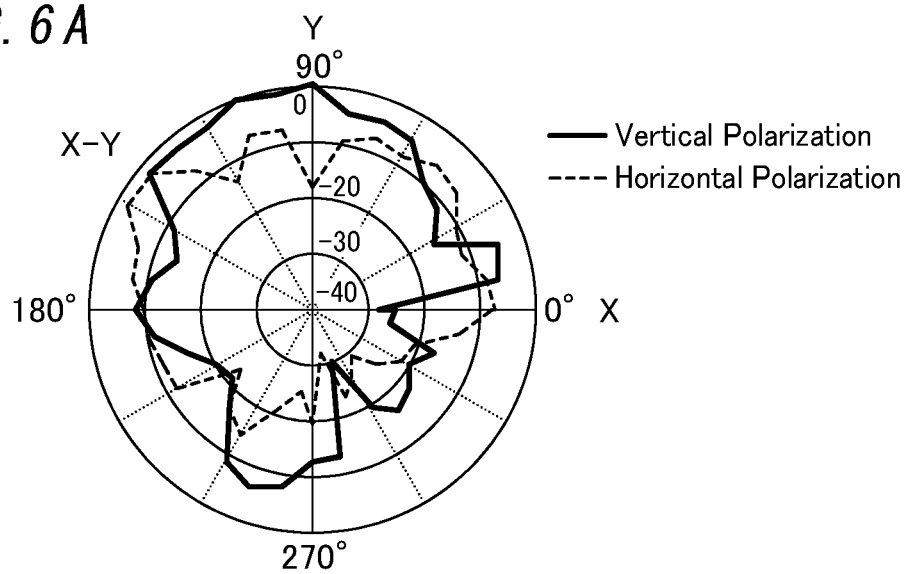
FIG. 6A is a characteristic diagram in X-Y directions, of the wireless communications unit of the ventilation device.
Figure 6B:
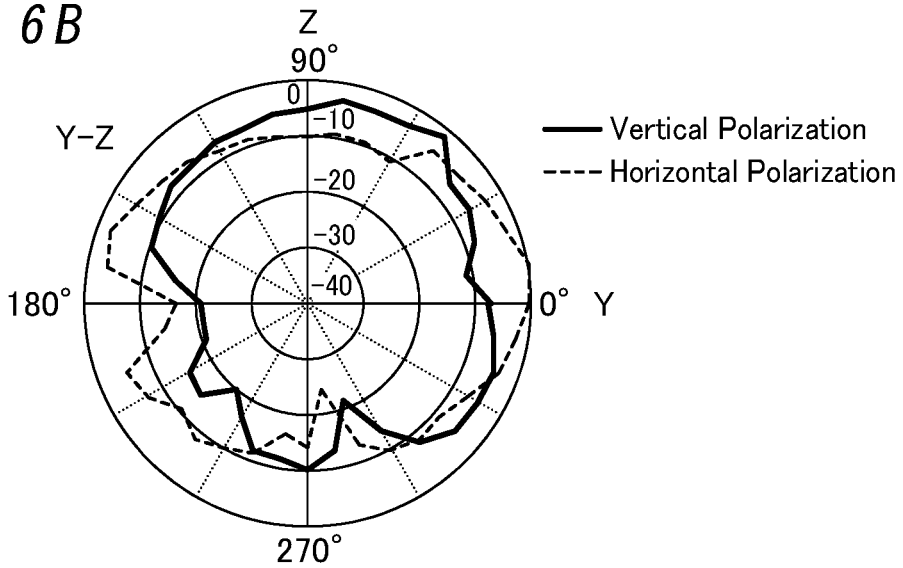
FIG. 6B is a characteristic diagram in Y-Z directions, of the wireless communications unit of the ventilation device.
Figure 6C:
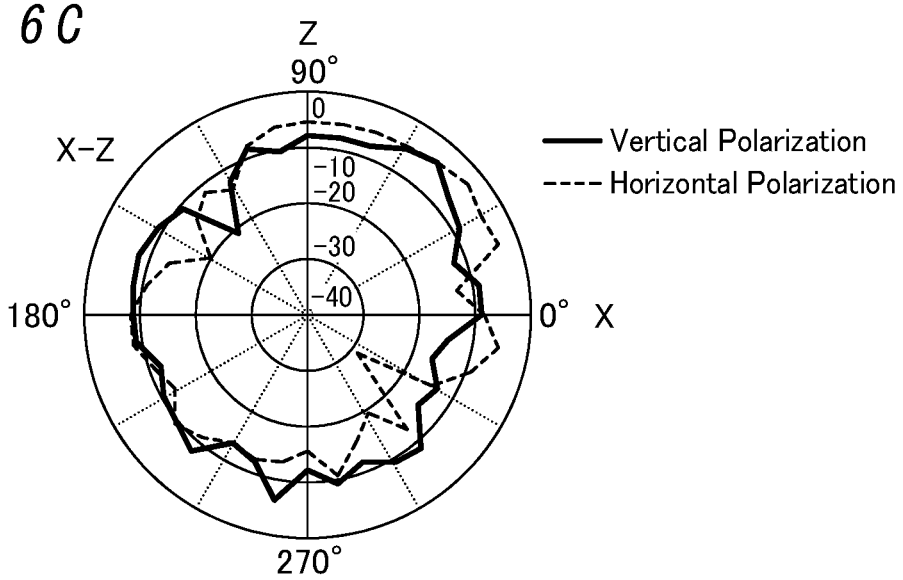
FIG. 6C is a characteristic diagram in X-Z directions, of the wireless communications unit of the ventilation device.
Figure 7A:
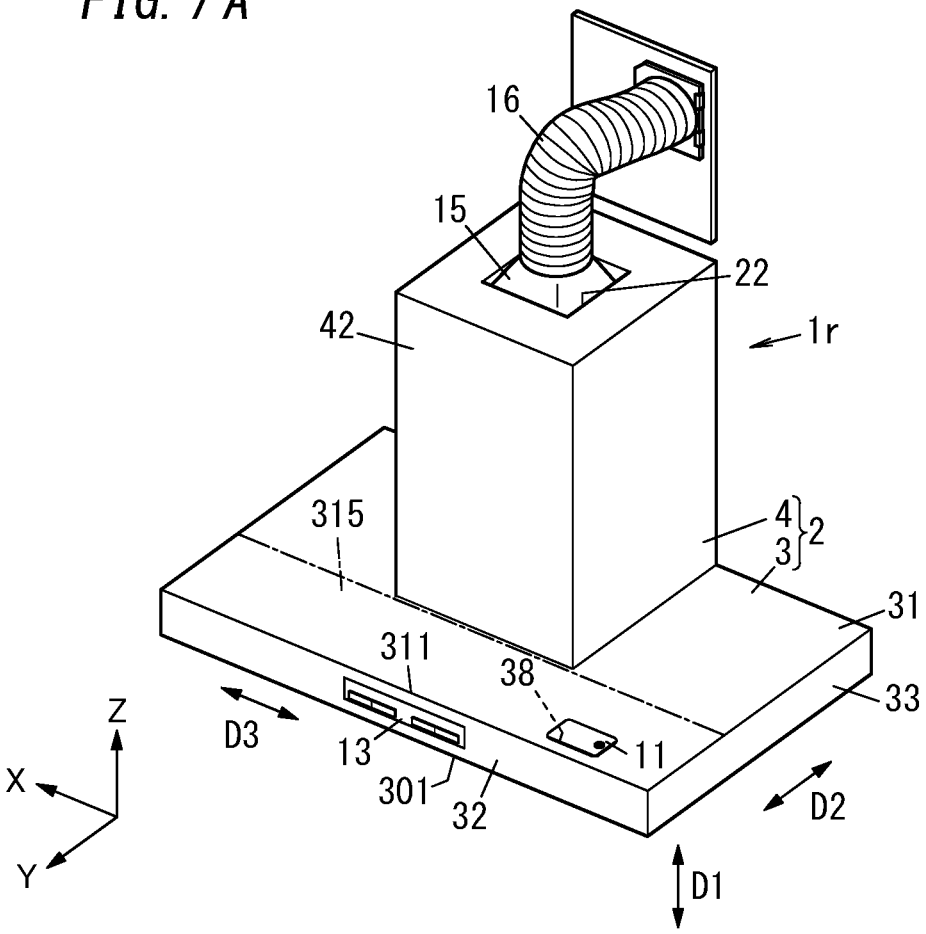
FIG. 7A is a perspective view of a ventilation device according to a comparative example, when viewed from above.
Figure 7B:
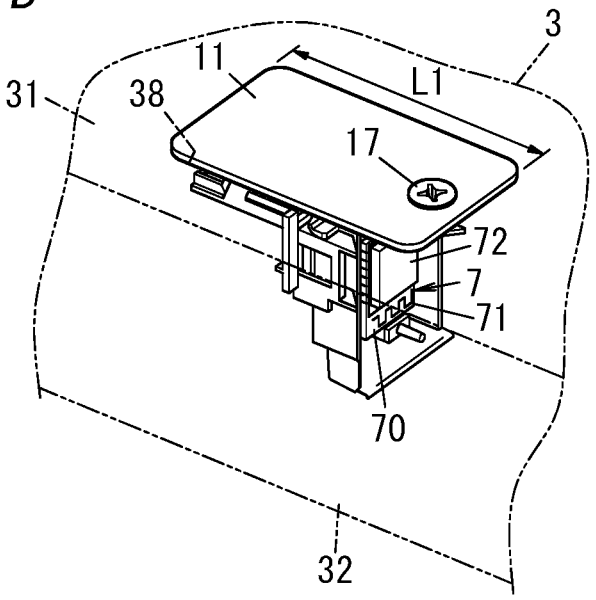
FIG. 7B is a see-through and perspective view of a wireless communications unit of the ventilation device according to the comparative example.

Each of FIGS. 6A and 8A shows communication characteristics (directivity) in a plane including the X-axis and the Y-axis. Each of FIGS. 6B and 8B shows communication characteristics (directivity) in a plane including the Y axis and the Z axis. Each of FIGS. 6C and 8C shows communication characteristics (directivity) in a plane including the X axis and the Z axis. In each of FIGS. 6A to 6C and 8A to 8C, a thick solid line shows characteristics of vertical polarization, and a dashed line shows characteristics of horizontal polarization.

Table 1 shown below represents a result of summarizing antenna gains and true values respectively corresponding to the antenna gains with respect to the directions in FIGS. 6A to 6C and 8A to 8C. In Table 1 shown below, "Ratio" in each direction denotes a value obtained by dividing the true value corresponding to the antenna gain of the wireless communications unit 7 of the ventilation device 1 according to the embodiment by the true value corresponding to the antenna gain of the wireless communications unit 7 of the ventilation device 1*r* according to the comparative example.

TABLE 1

| | +X direction | −X direction | +Y direction | −Y direction | +Z direction | −Z direction |
|---|---|---|---|---|---|---|
| Embodiment [dBi] | −8.5 | −8.0 | −5.5 | −10.7 | −9.3 | −6.4 |
| Comparative example [dBi] | −10.6 | −11.8 | −9.3 | −11.2 | −12.7 | −8.1 |
| Embodiment True value | 0.141 | 0.160 | 0.284 | 0.085 | 0.118 | 0.227 |
| Comparative example True value | 0.087 | 0.066 | 0.118 | 0.075 | 0.054 | 0.156 |
| Ratio | 1.6 | 2.4 | 2.4 | 1.1 | 2.2 | 1.5 |

From Table 1, it can be found that the respective true values corresponding to the antenna gains in the +X direction and −X direction of the wireless communications unit 7 of the ventilation device 1 according to the embodiment are 1.6 times and 2.4 times those of the wireless communications unit 7 of the ventilation device 1*r* according to the comparative example, and the communication performances in the +X direction and the −X direction can be improved.

Also from Table 1, it can be found that the respective true values corresponding to the antenna gains in the +Y direction and −Y direction of the wireless communications unit 7 of the ventilation device 1 according to the embodiment are 2.4 times and 1.1 times those of the wireless communications unit 7 of the ventilation device 1*r* according to the comparative example, and the communication performances in the +Y direction and the −Y direction can be improved.

Also from Table 1, it can be found that the respective true values corresponding to the antenna gains in the +Z direction and −Z direction of the wireless communications unit 7 of the ventilation device 1 according to the embodiment are 2.2 times and 1.5 times those of the wireless communications unit 7 of the ventilation device 1*r* according to the comparative example, and the communication performances in the +Z direction and the −Z direction can be improved.

(4) Advantages

In the ventilation device 1 according to the embodiment, the suction section 3 includes the first opening 38 and the second opening 39. The first opening 38 is in the upper surface 31 of the suction section 3, and overlapped with at least part of the wireless communications unit 7 in the upward-downward directions D1. The second opening 39 is in the front surface 32 of the suction section 3, and overlapped with at least part of the wireless communications unit 7 in the forward-backward directions D2. The ventilation device 1 according to the embodiment therefore can contribute to improving the communication performance.

The ventilation device 1 according to the embodiment and the ventilation system 100 including the ventilation device 1 can improve the antenna gain even in any direction of the upward-downward directions D1, the forward-backward directions D2 and the rightward-leftward directions D3, which can contribute to improving the communication performance. Accordingly, the ventilation device 1 according to the embodiment and the ventilation system 100 including the ventilation device 1 can increase the flexibility in the arrangement of each of the ventilation device 1 and the master device 101, and enhance the user convenience.

Also, in the ventilation device 1 according to the embodiment, the first opening 38 is between the front edge 311 of the upper surface 31 and the exhaust section 4 in the upper surface 31, which can reduce the chance that the communication environment of the wireless communications unit 7 is affected by the exhaust section 4, and therefore can contribute to improving the communication performance.

(5) Variation of Embodiment

Figure 9A:
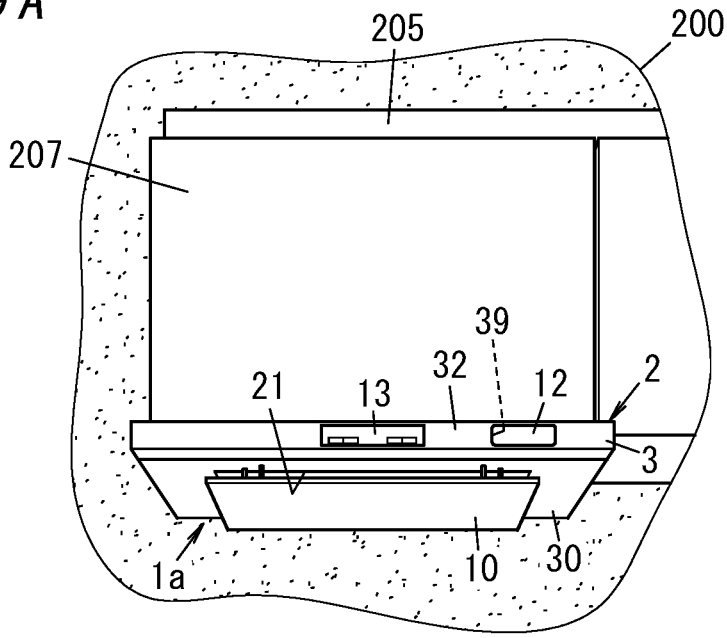
FIG. 9A is a perspective view for explaining an installation example of a ventilation device according to a first variation of the exemplary embodiment.
Figure 9B:
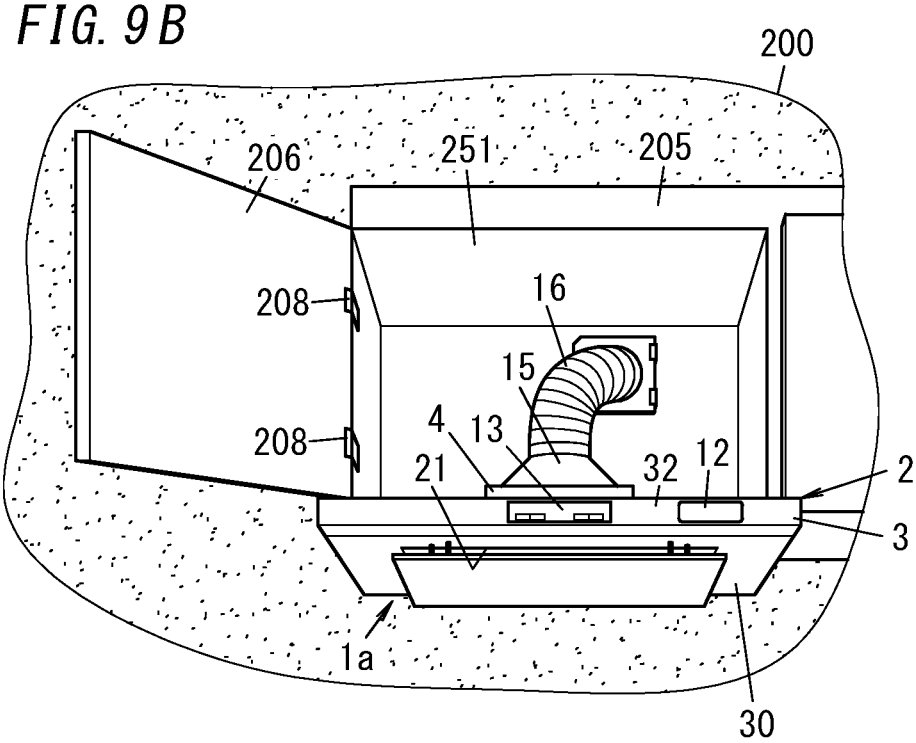
FIG. 9B is a perspective view for explaining the installation example of the ventilation device according to the first variation of the exemplary embodiment.

FIGS. 9A and 9B show a ventilation device 1*a* according to a variation of the embodiment. Regarding the ventilation device 1*a* according to the variation, elements similar to those of the ventilation device 1 according to the embodiment are assigned with same reference signs, and the explanations thereof are appropriately omitted.

The ventilation device 1*a* according to the variation is different from the ventilation device 1 according to the embodiment in that the ventilation device 1*a* includes an exhaust section 4, of which length in the upward-downward directions D1 is shorter than that of the exhaust section 4 of the ventilation device 1.

In the ventilation device 1*a* according to the variation, for example, the exhaust section 4 is partially disposed in an inner space of a storage box 205 installed in a residence 200. The storage box 205 includes an opening 251 in a front surface thereof. The opening 251 of the storage box 205 can be opened or closed by moving a door 206 attached to the storage box 205 with two hinges 208. The door 206 can be moved between a first position of opening the opening 251 of the storage box 205 and a second position of closing the opening 251.

The ventilation device 1*a* according to the first variation includes a suction section 3 that includes a first opening 38 (refer to FIG. 1A) and a second opening 39, similarly to the ventilation device 1 according to the embodiment. Therefore, the ventilation device 1*a* according to the first variation can contribute to improving the communication performance, similarly to the ventilation device 1 according to the embodiment.

(6) Other Variations

The embodiment described above is merely one of various exemplary embodiments of the present disclosure. The embodiment described above may be readily modified in various manners depending on the design or any other factor, as long as the purpose of the present disclosure can be achieved.

For example, the ventilation device 1 may be installed with being suspended from a ceiling of the residence 200.

In the ventilation device 1, the surface treatment may be appropriately applied to the main body case 2. Examples of the surface treatments include painting, plating, alumite treatment, and coating.

As long as the first opening 38 is overlapped with at least part of the wireless communications unit 7 in the upward-downward directions D1, it is not limited in particular, but from the viewpoint of further improving the communication performance, the first opening 38 is preferably overlapped with all of the wireless communications unit 7 in the upward-downward directions D1. Also as long as the second opening 39 is overlapped with at least part of the wireless communications unit 7 in the forward-backward directions D2, it is not limited in particular, but from the viewpoint of further improving the communication performance, the second opening 39 is preferably overlapped with all of the wireless communications unit 7 in the forward-backward directions D2.

In the ventilation device 1, the controller 8 may control the fan 5 based on an output of a sensor. The sensor may be, for example, a smoke sensor configured to detect smoke, a thermal sensor configured to detect heat, an air quality sensor configured to detect at least one of temperature, humidity, and $CO_2$ concentration, or a sensor configured to detect a state of the cooking device 210. The sensor may be provided in ventilation device 1, or may not be provided in the ventilation device 1.

In the ventilation device 1, the fan 5 is disposed in the inner space of the exhaust section 4 but should not be construed as limiting. As long as the fan 5 is disposed in the main body case 2, it may be disposed at another position. For example, the fan 5 may be disposed in the inner space of the suction section 3.

In the ventilation system 100 according to the embodiment, the information terminal 103 is not a component element of the ventilation system 100 but should not be construed as limiting. Alternatively, the ventilation system 100 may include the information terminal 103, as a component element of the ventilation system 100. In this case, the information terminal 103 may be configured to perform wireless communication with the wireless communications unit 7 of the ventilation device 1 without the repeater 102 and the master device 101, which can enhance the user convenience.

In the ventilation system 100 according to the embodiment, the repeater 102 is not a component element of the ventilation system 100 but should not be construed as limiting. Alternatively, the ventilation system 100 may include the repeater 102, as a component element of the ventilation system 100.

(Aspect)

This specification discloses the following aspects.

A ventilation device (1; 1*a*) according to a first aspect includes a main body case (2), a fan (5), a wireless communications unit (7), and a controller (8). The main body case (2) is made of metal. The main body case (2) includes a suction port (21) and an exhaust port (22). The fan (5) is disposed in the main body case (2). The wireless communications unit (7) includes an antenna (71), and is configured to perform wireless communication by using a radio wave having a prescribed wavelength as a medium. The controller (8) is connected to the wireless communications unit (7). The controller (8) is configured to control the fan (5) in accordance with a signal received by the wireless communications unit (7). The main body case (2) includes a suction section (3) and an exhaust section (4). The suction section (3) has a box shape. The suction section has a lower surface (30), an upper surface (31), and a front surface (32) connecting a front edge (301) of the lower surface (30) and a front edge (311) of the upper surface (31). The suction section (3) includes the suction port (21) in the lower surface (30). The exhaust section (4) is positioned on the upper surface (31) of the suction section (3) and includes the exhaust port (22). The suction section (3) includes a first opening (38) and a second opening (39). The first opening (38) is in the upper surface (31), and overlapped with at least part of the wireless communications unit (7) in upward-downward directions (D1). The second opening (39) is in the front surface (32), and overlapped with at least part of the wireless communications unit (7) in forward-backward directions (D2).

The ventilation device (1; 1*a*) according to the first aspect can contribute to improving communication performance.

In a ventilation device (1; 1*a*) according to a second aspect, which may be implemented in conjunction with the first aspect, the first opening (38) and the second opening (39) are overlapped with each other in the forward-backward directions (D2), when the main body case (2) is viewed from above.

The ventilation device (1; 1*a*) according to the second aspect can contribute to improving the communication performance.

In a ventilation device (1; 1*a*) according to a third aspect, which may be implemented in conjunction with the first or second aspect, the first opening (38) is overlapped with the antenna (71) in the upward-downward directions (D1).

The ventilation device (1; 1*a*) according to the third aspect can contribute to improving the communication performance.

In a ventilation device (1; 1*a*) according to a fourth aspect, which may be implemented in conjunction with any one of the first to third aspects, the second opening (39) is overlapped with the antenna (71) in the forward-backward directions (D2).

The ventilation device (1; 1*a*) according to the fourth aspect can contribute to improving the communication performance.

A ventilation device (1; 1*a*) according to a fifth aspect, which may be implemented in conjunction with any one of the first to fourth aspects, further includes a first cover (11) and a second cover (12). The first cover (11) is disposed to cover the first opening (38), and allows the radio wave to pass through the first cover (11). The second cover (12) is disposed to cover the second opening (39), and allows the radio wave to pass through the second cover (12).

The ventilation device (1; 1*a*) according to the fifth aspect can protect the wireless communications unit (7).

In a ventilation device (1; 1*a*) according to a sixth aspect, which may be implemented in conjunction with the fifth aspect, material of the first cover (11) includes a resin.

In a ventilation device (1; 1*a*) according to a seventh aspect, which may be implemented in conjunction with the fifth or sixth aspect, material of the second cover (12) includes a resin.

In a ventilation device (1; 1*a*) according to an eighth aspect, which may be implemented in conjunction with any one of the first to seventh aspects, a maximum opening width (L1) of the first opening (38) in directions (D3) perpendicular to all the upward-downward directions (D1) and the forward-backward directions (D2) is larger than a half of the prescribed wavelength.

The ventilation device (1; 1*a*) according to the eighth aspect can contribute to improving the communication performance.

In a ventilation device (1; 1*a*) according to a ninth aspect, which may be implemented in conjunction with any one of the first to eighth aspects, a maximum opening width (L2) of the second opening (39) in directions (D3) perpendicular to all the upward-downward directions (D1) and the forward-backward directions (D2) is larger than a half of the prescribed wavelength.

The ventilation device (1; 1*a*) according to the ninth aspect can contribute to improving the communication performance.

In a ventilation device (1; 1*a*) according to a tenth aspect, which may be implemented in conjunction with any one of the first to ninth aspects, the first opening (38) has an opening shape like a rectangle or square.

The ventilation device (1; 1*a*) according to the tenth aspect can increase an opening area of the first opening (38), and can therefore contribute to improving the communication performance.

In a ventilation device (1; 1*a*) according to an eleventh aspect, which may be implemented in conjunction with any one of the first to tenth aspects, the second opening (39) has an opening shape like a rectangle or square.

The ventilation device (1; 1*a*) according to the eleventh aspect can increase an opening area of the second opening (39), and can therefore contribute to improving the communication performance.

A ventilation system (100) according to a twelfth aspect includes the ventilation device (1; 1*a*) according to any one of the first to eleventh aspects, and an apparatus (master device 101). The apparatus (master device 101) is configured to perform wireless communication with the wireless communications unit (7) of the ventilation device (1; 1*a*).

The ventilation system (100) according to the twelfth aspect can contribute to improving the communication performance.

REFERENCE SIGNS LIST

1, 1*a* Ventilation Device
2 Main Body Case
21 Suction Port
22 Exhaust Port
3 Suction Section
30 Lower Surface

301 Front Edge
31 Upper Surface
311 Front Edge
32 Front Surface
38 First Opening
39 Second Opening
4 Exhaust Section
5 Fan
7 Wireless Communications Unit
71 Antenna
8 Controller
11 First Cover
12 Second Cover
100 Ventilation System
101 Master Device (Apparatus)
D1 Upward-downward Directions
D2 Forward-backward Directions
D3 Directions
L1 Maximum Opening Width
L2 Maximum Opening Width

The invention claimed is:

1. A ventilation device, comprising:

a main body case made of metal, and including a suction port and an exhaust port;

a fan disposed in the main body case;

a wireless communications unit including an antenna, and configured to perform wireless communication by using a radio wave having a prescribed wavelength as a medium; and a controller connected to the wireless communications unit, and configured to control the fan in accordance with a signal received by the wireless communications unit, the main body case including:

a suction section having a box shape, and including the suction port, the suction section having a lower surface, an upper surface, and a front surface connecting a front edge of the lower surface and a front edge of the upper surface; and an exhaust section positioned on the upper surface of the suction section, and including the exhaust port, the suction section including:

a first opening being in the upper surface, and overlapped with at least part of the wireless communications unit in upward-downward directions; and a second opening being in the front surface, and overlapped with at least part of the wireless communications unit in forward-backward directions.

2. The ventilation device of claim 1, wherein the first opening and the second opening are overlapped with each other in the forward-backward directions, when the main body case is viewed from above.

3. The ventilation device of claim 1, wherein the first opening is overlapped with the antenna in the upward-downward directions.

4. The ventilation device of claim 1, wherein the second opening is overlapped with the antenna in the forward-backward directions.

5. The ventilation device of claim 1, further comprising:

a first cover disposed to cover the first opening, and allowing the radio wave to pass through the first cover; and a second cover disposed to cover the second opening, and allowing the radio wave to pass through the second cover.

6. The ventilation device of claim 5, wherein material of the first cover includes a resin.

7. The ventilation device of claim 5, wherein material of the second cover includes a resin.

8. The ventilation device of claim 1, wherein a maximum opening width of the first opening in directions perpendicular to all the upward-downward directions and the forward-backward directions is larger than a half of the prescribed wavelength.

9. The ventilation device of claim 1, wherein a maximum opening width of the second opening in directions perpendicular to all the upward-downward directions and the forward-backward direction is larger than a half of the prescribed wavelength.

10. The ventilation device of claim 1, wherein the first opening has an opening shape like a rectangle or square.

11. The ventilation device of claim 1, wherein the second opening has an opening shape like a rectangle or square.

* * * * *